US006752546B2

(12) United States Patent
Itoh

(10) Patent No.: US 6,752,546 B2
(45) Date of Patent: Jun. 22, 2004

(54) PHOTOSENSITIVE MATERIAL PROCESSING RACK AND APPARATUS

(75) Inventor: Koji Itoh, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/657,120

(22) Filed: Sep. 9, 2003

(65) Prior Publication Data

US 2004/0057721 A1 Mar. 25, 2004

(30) Foreign Application Priority Data

Sep. 19, 2002 (JP) ..... 2002-273898

(51) Int. Cl.[7] ..... G03D 3/08

(52) U.S. Cl. ..... 396/612; 396/620; 396/624; 355/27

(58) Field of Search ..... 396/612, 617, 396/620, 624; 355/27–29; 134/64 P, 64 R

(56) References Cited

FOREIGN PATENT DOCUMENTS

JP 11-352656 12/1999

*Primary Examiner*—D. Rutledge
(74) *Attorney, Agent, or Firm*—Sughrue Mion, PLLC

(57) ABSTRACT

A rack comprises feed rollers, sidewall members, a base member, a top wall member, a bottom plate, guide members, and a grip. The inside of the top wall member is hollow, and filling liquid is loaded therein. A processing tank contains rinsing solution. The rack gets snagged on the upper end of the processing tank. Since the filling liquid increases the total weight of the rack, the rack is prevented from floating in the processing tank by buoyant force.

13 Claims, 6 Drawing Sheets

PHOTOSENSITIVE MATERIAL PROCESSING RACK AND APPARATUS

BACKGROUND OF THE INVENTION

1. Field of the Invention

The present invention relates to a photosensitive material processing rack used for developing a photosensitive material such as a photo film, a color paper, and a photosensitive material processing apparatus provided with the rack.

2. Background Arts

A photosensitive material processing apparatus used in a photo-lab and the like is composed of feed rollers for feeding an exposed photosensitive material, and plural processing tanks containing various types of processing solution used for color development, bleach fixation, rinse, stabilization and the like. The photosensitive material fed by the feed rollers is subject to the processes of development, fixation, and rinse while sequentially passing through the various types of processing solution contained in the processing tanks.

As disclosed in Japanese Patent Laid-Open Publication No. 11-352656, for example, a photosensitive material processing rack, which is hung on the upper end of the processing tank, holds the feed rollers. In addition to the feed rollers, the rack has a pair of sidewalls for holding the ends of the feed rollers, and drive shafts for driving the feed rollers.

Since the processing rack is so designed as to have heavier weight than buoyant force exerted on the processing rack soaked in the processing solution, the processing rack is fixed on the processing tank without floating. The size of the processing rack is larger than the volume of the processing solution necessary for processing the photosensitive material. In view of reducing processing cost, the inside of the processing rack is made hollow to increase the volume thereof, for the purpose of filling the processing tank with a small amount of processing solution. Increase in the volume brings increase in the buoyant force exerted on the processing rack, so that the processing rack is unstably fitted into the processing tank.

When the processing rack is unstable, the processing rack may be shifted from a proper position or may be detached from the processing tank due to the operational vibration caused by the processing apparatus, torque from a drive source for driving the feed rollers and the like. In such a case, the misalignment of a feeding path for feeding the photosensitive material causes poor feeding and clogging of the photosensitive material, so that the photosensitive material tends to be bent or damaged. To stably fix the processing rack in the processing tank, it is considerable to provide a fixing member. In this case, however, increase in the number of parts causes increase in manufacturing cost of the processing apparatus.

SUMMARY OF THE INVENTION

An object of the present invention is to provide a photosensitive material processing apparatus, at low cost, in which a photosensitive material processing rack is easily and stably fixed in a processing tank.

To achieve the above object, a photosensitive material processing rack according to the present invention comprises a housing, a feed roller pair provided in the housing, and a weight detachably loaded into and/or onto the housing. The feed roller pair feeds a photosensitive material along a feeding path in the processing tank. The weight stably fixes the rack in the processing tank against buoyant force exerted on the rack in the processing solution.

In the housing, at least one hollow portion may be formed. In this case, the weight is loaded into the hollow portion.

The photosensitive material processing rack satisfies the following formulas:

$$\beta > (V \times \alpha - W)/X$$

$$V \times \alpha > W$$

wherein, W is the weight of the rack without the weight, V is the volume of apart of the rack soaked in the processing solution, $\alpha$ is the specific gravity of the processing solution, $\beta$ is the specific gravity of the weight, and X is the volume of the weight.

The photosensitive material processing rack may further satisfies the following formula:

$$X \leqq v$$

wherein, v is the volume of a hollow portion formed inside the housing.

According to the present invention, since the photosensitive material processing rack has enough weight by loading weights, it is possible to stably fix the processing rack in the processing tank. When the processing rack is detached from the processing tank, the weights are removed to lighten the weight of the processing rack, so that workability is improved.

BRIEF DESCRIPTION OF THE DRAWINGS

The above objects and advantages of the present invention will become apparent from the following detailed descriptions of the preferred embodiments when read in association with the accompanying drawings, which are given by way of illustration only and thus do not limit the present invention. In the drawings, the same reference numerals designate like or corresponding parts throughout the several views, and wherein.

DETAILED DESCRIPTION OF THE EMBODIMENTS

Figure 1:
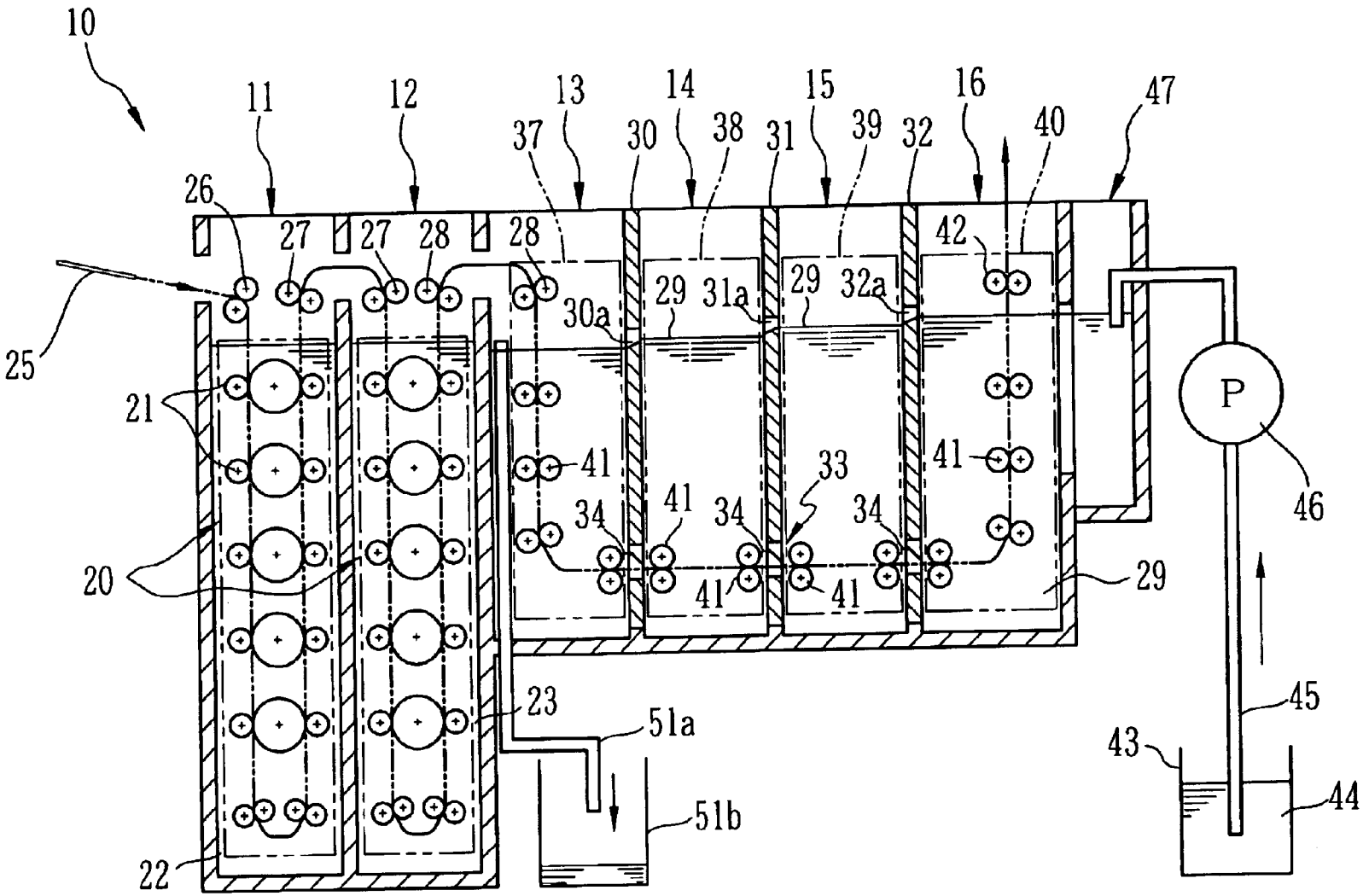
FIG. 1 is a schematic view of a photosensitive material processing apparatus.

Referring to FIG. 1, a photosensitive material processing apparatus 10 comprises a color development tank 11, a bleach/fixation tank 12, and first to forth rinse tanks 13, 14, 15 and 16. In the cascade type of rinse tanks 13, 14, 15 and 16, rinsing solution overflows from a downstream side to an upstream side with respect to the feeding direction of a photosensitive material 25.

A processing rack 20 is fixed in each of the color development tank 11 and the bleach/fixation tank 12. The processing rack 20 holds plural feed roller pairs 21 for feeding the photosensitive material (color paper) 25. The feed roller pairs 21 feed the photosensitive material 25 in such a manner that the photosensitive material 25 passes through color developing solution 22 and bleach/fixing solution 23. The photosensitive material 25 is subject to color development and bleach/fixation processes while being fed in the color development solution 22 and the bleach/fixing solution 23.

A guide roller 26 for guiding the photosensitive material 25 to the color development tank 11 is disposed in the upstream of the color development tank 11. Two pairs of squeeze rollers 27 are disposed between the color development tank 11 and the bleach/fixation tank 12 to guide the photosensitive material 25, having passed through the color development tank 11, to the bleach/fixation tank 12. Two pairs of squeeze rollers 28 are disposed between the bleach/fixation tank 12 and the first rinse tank 13 to guide the photosensitive material 25, having passed through the bleach/fixation tank 12, to the first rinse tank 13.

Rinsing solution 29 is contained in the first to fourth rinse tanks 13 to 16. Each of first to third partitions 30 to 32 for partitioning the rinse tanks 13 to 16 is provided with a blade 34 as seal means. The blade 34 prevents the rinsing solution 29 from passing, but allows the photosensitive material 25 to pass. The photosensitive material 25 is fed from the first rinse tank 13 to the fourth rinse tank 16 in the rinsing solution 29 along a feeding path 33 formed by the blades 34.

Racks 37 to 40 are fitted into the first to fourth rinse tanks 13 to 16, respectively. Each rack 37 to 40 holds feed rollers 41 for feeding the photosensitive material 25. The photosensitive material 25 rinsed in the first to fourth rinse tanks 13 to 16 is fed into a dry section (not illustrated) by a pair of ejection rollers 42.

A refill tank 43 contains rinsing solution for refill. A conveying pump 46 pumps a predetermined amount (an amount corresponding to evaporation of the rinsing solution and the processed photosensitive material) of rinsing solution into the fourth rinse tank 16 through a conveying pipe 45 put into the refill tank 43 and a sub tank 47. Accordingly, the fourth rinse tank 16 is refilled with the fresh rinsing solution flowing from the sub tank 47. When the liquid level of the fourth rinse tank 16 exceeds an opening 32*a* provided in the upper portion of the partition 32, the rinsing solution flows downward from the fourth rinse tank 16 into the third rinse tank 15 via the opening 32*a*. The rinsing solution flows downward into the second and first rinse tanks 14 and 13 through openings 31*a* and 30*a* of the partitions 31 and 30 in a like manner. The first rinse tank 13 is provided with an ejection pipe 51*a* for ejecting over the predetermined amount of rinsing solution. The overflowing rinsing solution flows into a reservoir 51*b* through the ejection pipe 51*a*.

Figure 2:
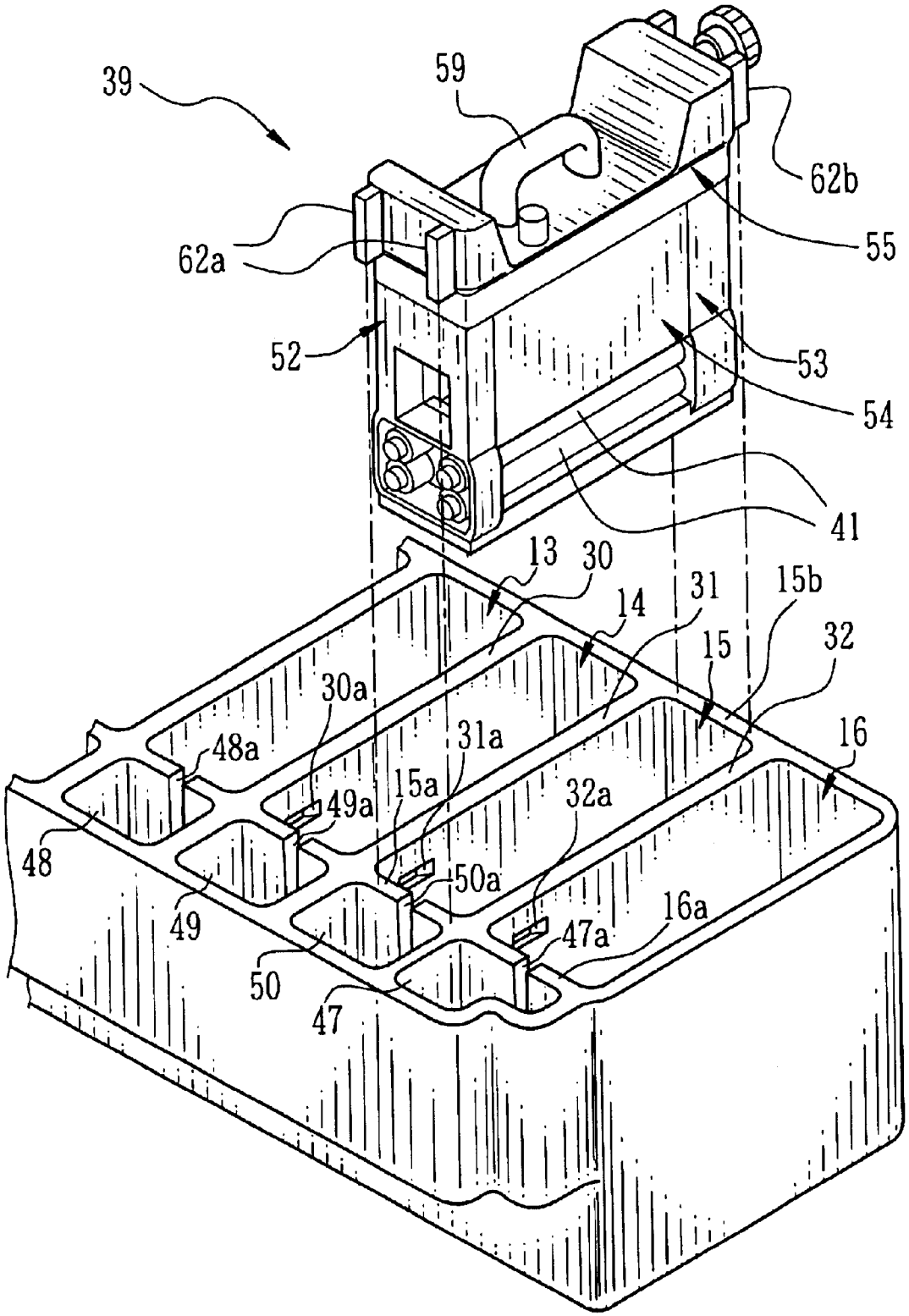
FIG. 2 is a perspective view of rinse tanks and a photosensitive material processing rack.

Referring to FIG. 2, the sub tank 47 is provided adjacent to the fourth rinse tank 16. An outlet 47*a* extending vertically is formed in a partition 16*a* between the sub tank 47 and the fourth rinse tank 16. The rinsing solution 29 in the sub tank 47 flows into the fourth rinse tank 16 through the outlet 47*a*. The first to third rinse tanks 13 to 15 have sub tanks 48 to 50, respectively. The rinsing solution flows from the sub tanks 48 to 50 to the first to third rinse tanks 13 to 15 through outlets 48*a* to 50*a*, respectively.

Figure 3:
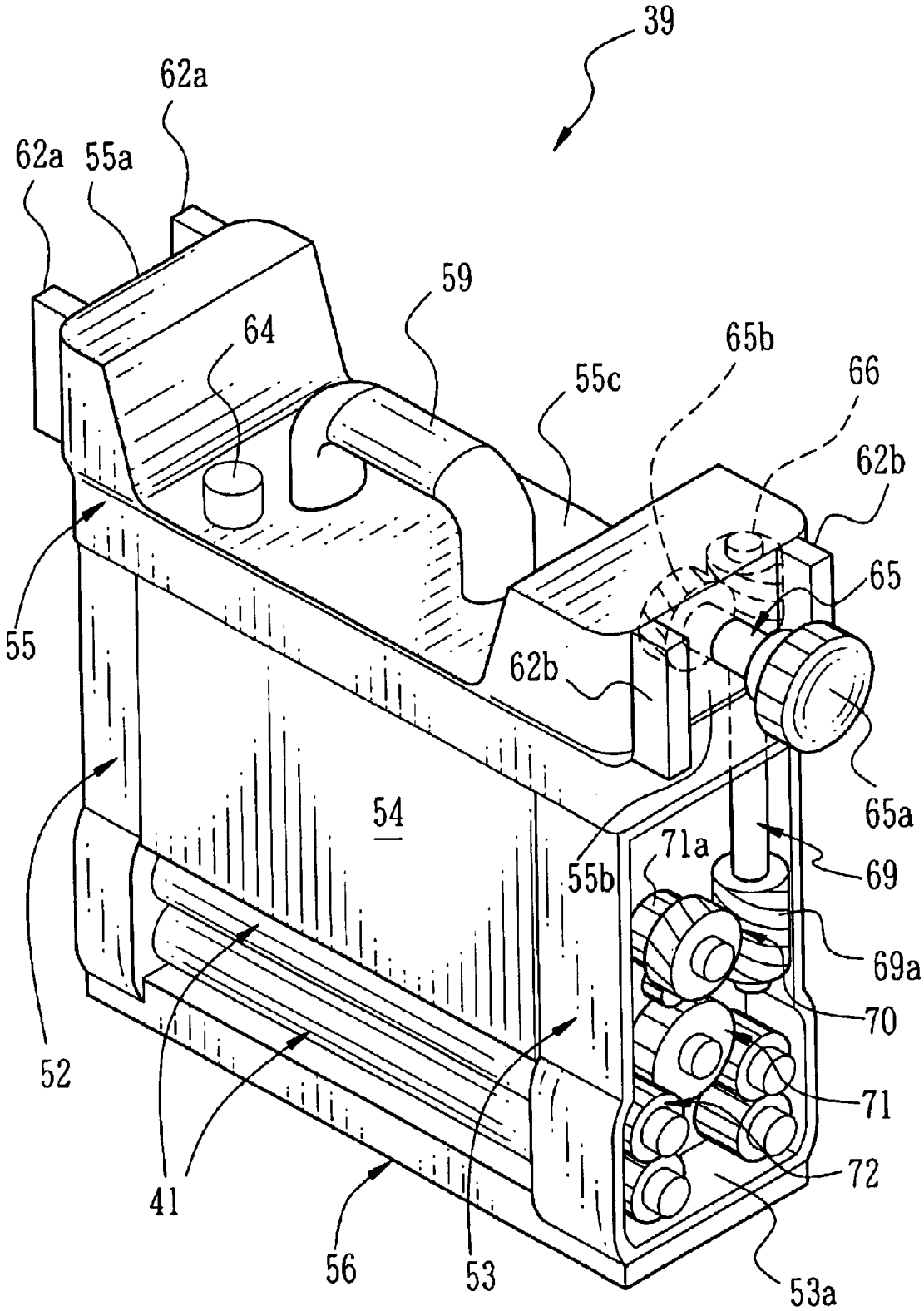
FIG. 3 is an enlarged perspective view of the photosensitive material processing rack.
Figure 4:
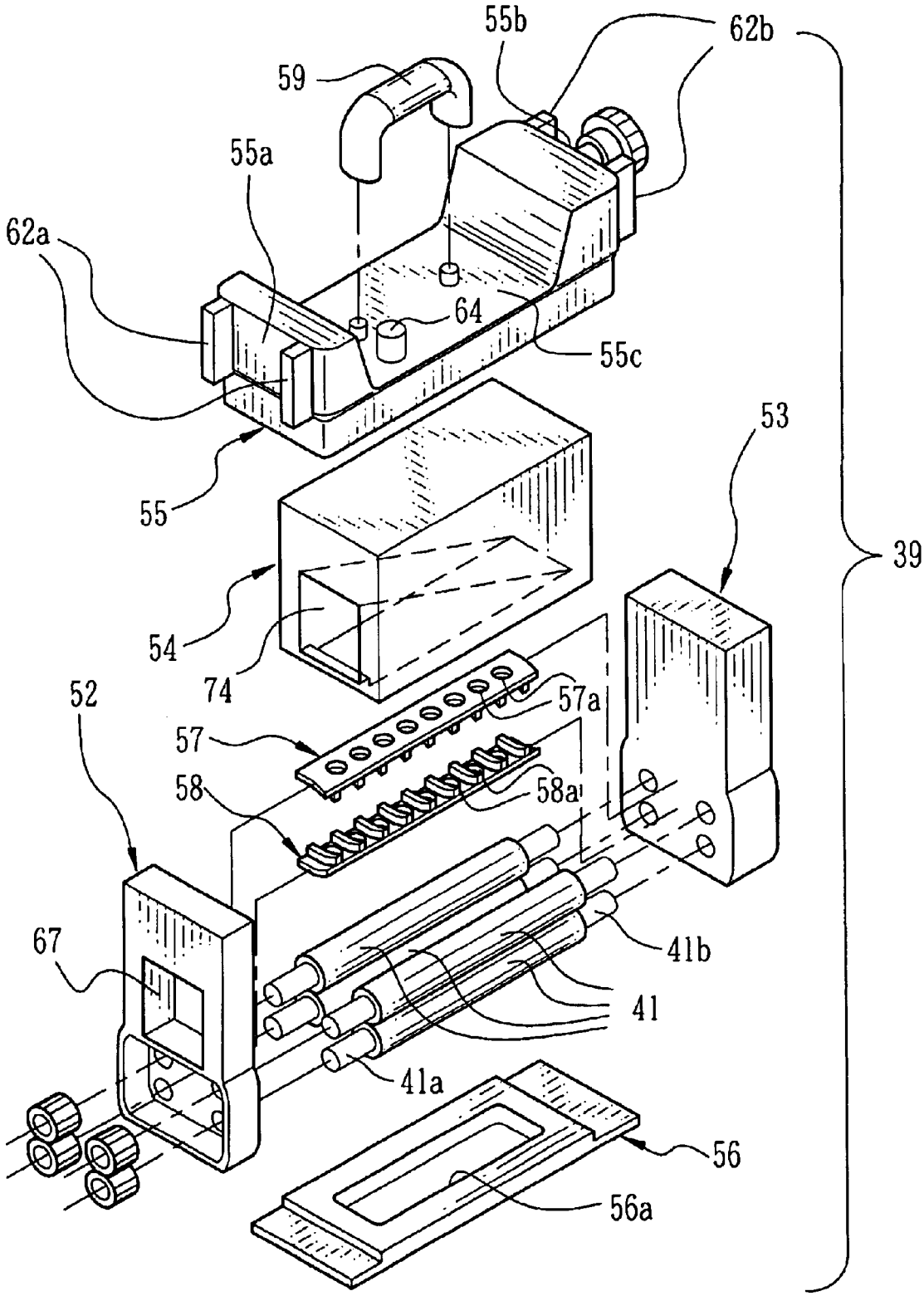
FIG. 4 is an exploded perspective view of the photosensitive material processing rack.
Figure 5:
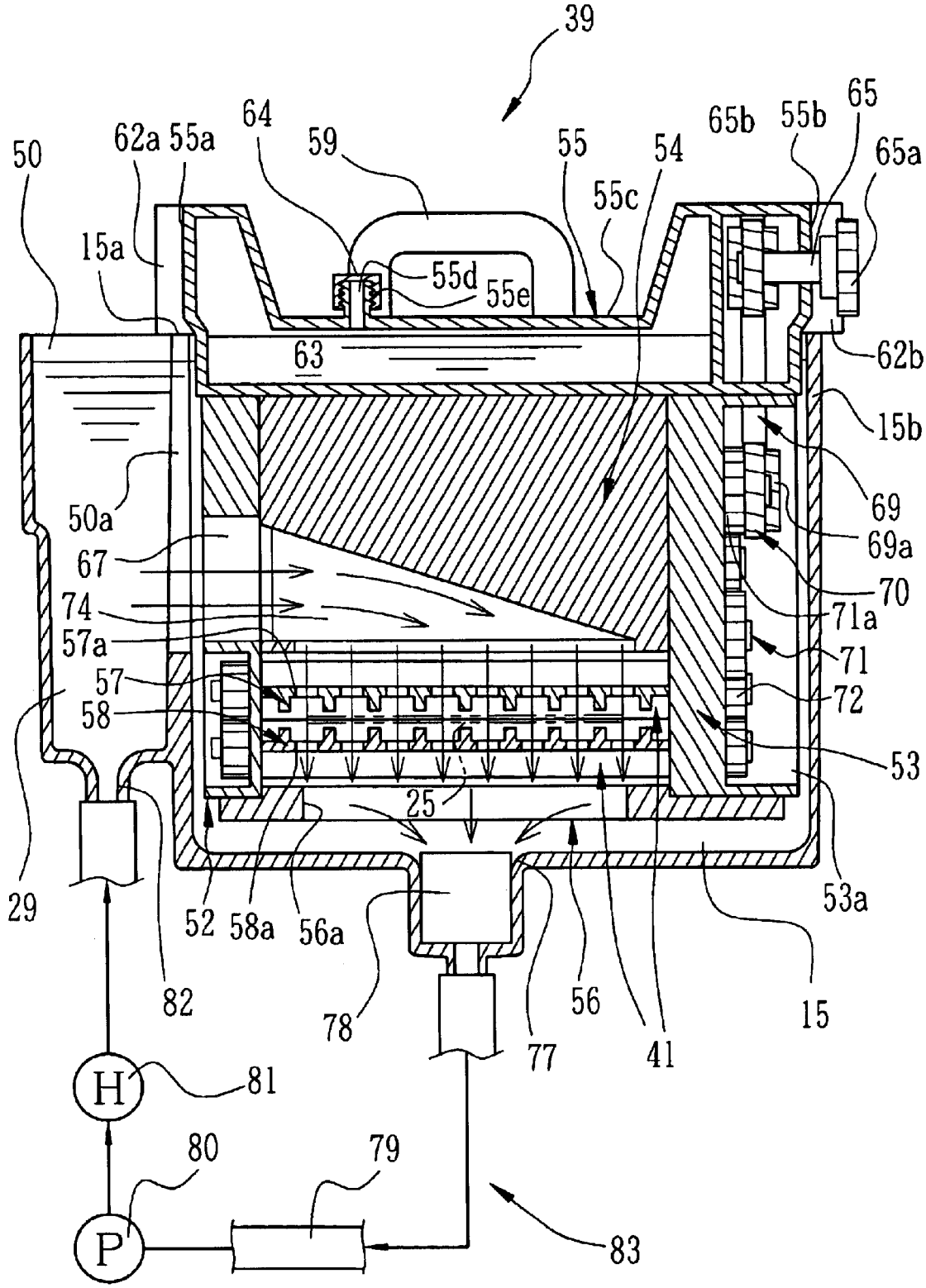
FIG. 5 is a sectional view of a main portion of the rinse tank in which the photosensitive material processing rack is fixed.

Referring to FIGS. 3 to 5, the rack 39 as a photosensitive material processing rack comprises the feed rollers 41, sidewall members 52 and 53, a base member 54, a top wall member 55, a bottom plate 56, guide plates 57 and 58, and a grip 59. The sidewall members 52 and 53, the base member 54, the top wall member 55, and the bottom plate 56 constitute the housing of the rack 39. Since the rack 38 for the second rinse tank 14 has the same structure as the rack 39 for the third rinse tank 15, the detailed description thereof is omitted. Since the racks 37 and 40 for the first and fourth rinse tanks 13 and 16 have the almost same structure as the rack 39 for the third rinse tank 15, except for having feed rollers aligned vertically, the detailed description thereof is omitted.

Two holding ribs 62*a* protruding horizontally are formed in one side 55*a* of the top wall member 55, and two holding ribs 62*b* are formed in the other side 55*b* thereof. When the rack 39 is fitted into the third rinse tank 15, as shown in FIG. 5, the holding ribs 62*a* and 62*b* are hooked on the upper ends of the sidewalls 15*a* and 15*b* of the rinse tank 15, so that the rack 39 is stably held in the rinse tank 15.

The top wall member 55 is hollow, and filled with filing liquid (water for instance), as a filler. The filling liquid 63 is poured through an inlet 55*e* formed in the top face 55*c* of the top wall member 55. A screw cap 64 as a lid member is fitted over the inlet 55*d*, with screwing onto screw thread 55*e* formed around the inlet 55*d*. The screw cap 64 encloses the top wall member 55 to prevent the filling liquid 63 from leaking outside. When the rack 39 is fixed in the third rinse tank 15, the inlet 55*d* is positioned above the liquid level of the rinsing solution 29. It is preferable that the specific gravity of the filling liquid 63 is larger than that of the rinsing solution 29. The filling liquid 63 may be in a gel state. The lid member is not limited to the screw cap as long as it can enclose the inlet 55*d*. The lid member may be, for example, a rubber cap, or a bolt having a male screw thread screwing onto the inlet 55*d*.

A rotational shaft 65 which is integrally provided with a sprocket 65*a* and a worm gear 65*b* is rotatably held in one side of the top wall member 55. A worm wheel 66 engaged with the worm gear 65*b* is disposed inside the top wall member 55. When the rack 39 is fitted into the third rinse tank 15, the sprocket 65*a* is engaged with a roller chain (not-illustrated). The rotation of a motor as a drive source is transmitted to the sprocket 65*a* via the roller chain.

The sidewall members 52 and 53 rotatably hold the ends 41*a* and 41*b* of the feed rollers 41. The sidewall member 52 and 53 are secured to both the side faces of the base member 54 with screws and the like. The top wall member 55 is secured to the top face of the sidewall members 52 and 53 and the base member 54, and the bottom plate 56 is secured to the bottom face thereof. An approximately rectangular opening 56*a* is formed in the middle of the bottom plate 56.

The guide members 57 and 58 are secured to the sidewall members 52 and 53 in such a manner as to be opposed to each other across and near the feed rollers 41. Many pierce holes 57*a* and 58*a* are formed the guide members 57 and 58. Since the rinsing solution 29 circulates through the pierce holes 57*a* and 58*a*, it is possible to prevent the ingredient density, temperature and foreign matter of the rinsing solution 29 from being dense. The grip 59 is secured to the top face of the top wall member 55 with screws. A user can easily carry the rack 39 with holding the grip 59.

Referring to FIG. 3, a gear chamber 53*a* is formed in the sidewall member 53 to install various gears. A worm wheel 69*a* integral with a rotational shaft 69, a worm gear 70, a gear train 71, and a drive gear 72 are disposed in the gear chamber 53*a*. The worm wheel 66 is secured to the upper end of the rotational shaft 69. The worm wheel is engaged with the wormgear 70. A gear 71*a* in the upper portion of the gear train 71 is integral with the worm gear 70, and the lower end of the gear train 71 is engaged with the drive gear 72 which is secured to one end of the feed roller 41.

Thus, when the motor rotates, the rotation is transmitted to the worm wheel 69*a* via the sprocket 65*a*, the worm gear 65*b*, and the worm wheel 66. Since the rotation of the worm wheel 69*a* is transmitted to the drive gear 72 via the worm gear 70 and the gear train 71, the feed roller 41 integral with the drive gear 72 rotates.

Referring to FIGS. 4 and 5, an opening 67 is so formed in the lower portion of the sidewall member 52 as to be adjacent to the outlet 50*a*. In the lower portion of the base member 54, a penetration hole 74 which penetrates between the side face adjacent to the sidewall member 52 and the bottom face is formed. The rinsing solution 29 flowing from the sub tank 50 through the outlet 50*a* and the opening 67 flows downward into the penetration hole 74. Then, the rinsing solution flows into the bottom of the third rinse tank 15 through the pierce holes 57*a* and 58*a* of the guide members 57 and 58 and the opening 56*a* of the bottom plate 56.

An intake gate 77 is formed in the bottom of the third tank 15. A filter 78 is disposed in the intake gate 77 to eliminate dust and foreign matter from the rinsing solution 29. The rinsing solution 29 filtered by the filter 78 flows into a circulating pump 80 through a circulating pipe 79. The circulating pump 80 pumps the rinsing solution 29 into a heater 81. The heater 81 heats the rinsing solution 29 to regulate the temperature of the rinsing solution 29. The rinsing solution 29 regulated to proper temperature returns into the sub tank 50 via a connection gate 82 provided in the bottom of the sub tank 50.

A circulating system 83, comprising the sub tank 50, the filter 78, the circulating pump 80, the heater 81 and the like, forms a circulating flow of the rinsing solution 29 from the upper portion to the bottom in the third rinse tank 15. The rinsing solution 29 flows from the filter 78, disposed in the bottom of the third rinse tank 15, to the sub tank 50 through the circulating pump 80 and the heater 81, and then returns to the third rinse tank 15 through the outlet 50*a* provided in the side thereof. The rinsing solution 29, as described above, circulates through the openings 67 and 56*a*, the penetration hole 74 and the pierce holes 57*a* and 58*a*, with passing through the inside of the rack 39.

As in the case of the third rinse tank 15, each of the first, second and fourth rinse tanks 13, 14 and 16 is provided with a circulating system which comprises the sub tank 48, 49 or 47, a filter, a circulating pump, a heater and the like. The rinsing solution 29 is circulated by each circulating system with passing through the inside of the rack 37, 38 and 40. In the fourth rinse tank 16, the rinsing solution 29 circulates in an opposite direction to that described above, because the sub tank 47 is refilled with the rinsing solution 29. In other words, the rinsing solution 29 in the sub tank 47 flows into the rinse tank 16 through the heater and the circulating pump, and then returns to the sub tank 47.

The operation of the photosensitive material processing apparatus will be hereinafter described. In taking the rack 39 out of the third rinse tank 15 for maintenance, the screw cap 64 is taken off to eject the filling liquid 63 from the top wall member 55. Accordingly, lightening the weight of the rack 39 makes it possible to improve workability.

In fixing the rack 39 in the third rinse tank 15, on the other hand, the filling liquid 63 is loaded into the top wall member 55 as much as possible. Then, the rack 39 is fitted into the third rinse tank 15 with snagging the holding ribs 62*a* and 62*b* of the rack 39 on the sidewalls 15*a* and 15*b*. Since filling liquid 63 loaded into the top wall member 55 increases the weight of the rack 39, the rack 39 does not float with the buoyant force exerted on the rack 39. If the rack 39 has not enough weigh, the rack 39 tends to be detached from the rinse tank 15 due to vibration which occurs during the operation of the photosensitive material processing apparatus 10, torque from the drive source of the feed rollers 41 and the like. The rack 39 having enough weight with the filling liquid 63, however, is securely fixed in the rinse tank 15.

Figure 6:
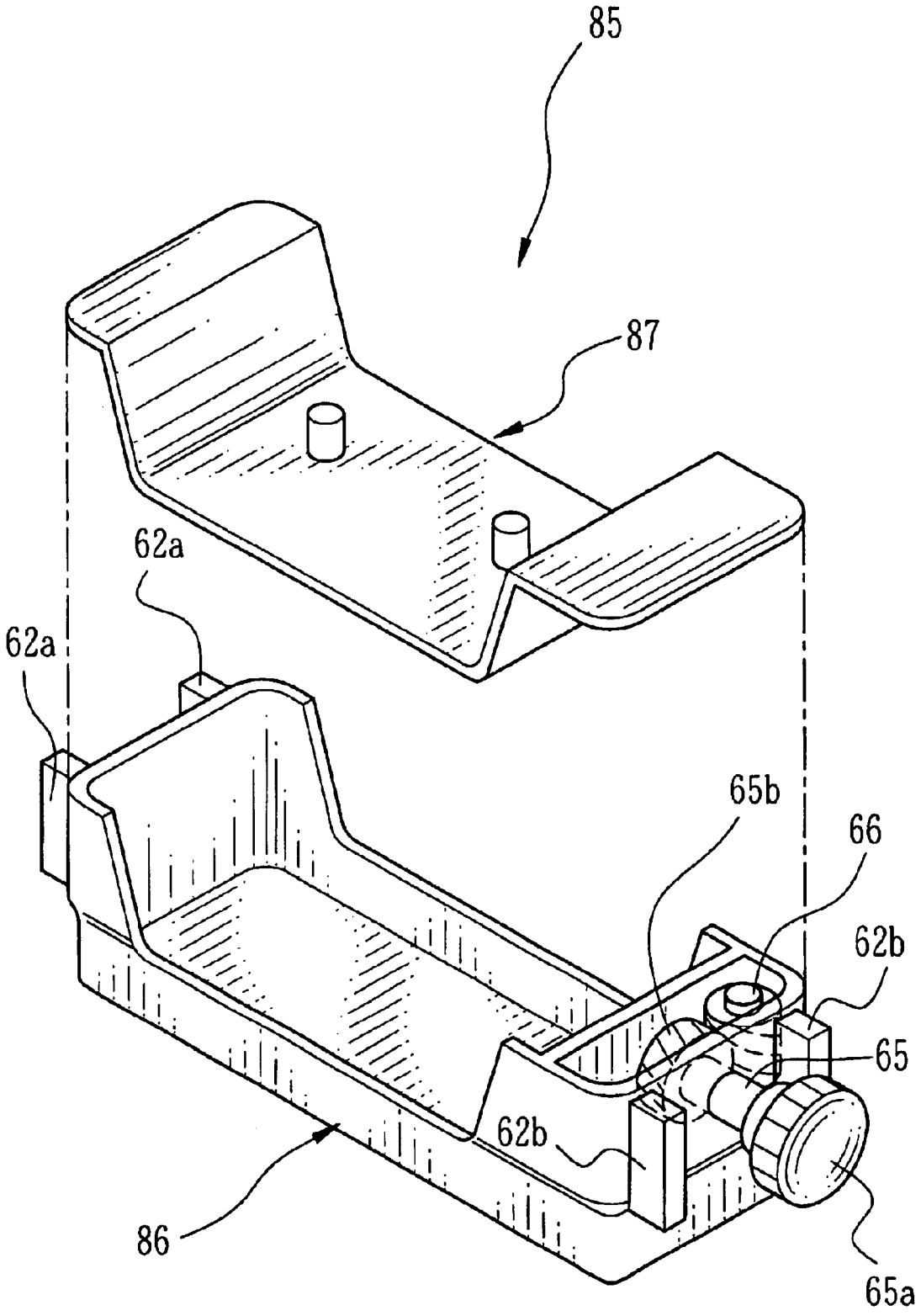
FIG. 6 is an exploded perspective view showing the components of a photosensitive material processing rack according to another embodiment.

In the above embodiment, the top wall member 55 has a hollow portion with the inlet 55*d*. The filling liquid is loaded into the top wall member 55 through the inlet 55*d*. As shown in FIG. 6, however, a top wall member 85 which comprises a casing 86 and a top lid 87 fitted over the casing 86 may be used instead. In FIG. 6, the same reference numbers as the above embodiment refer to identical parts and members, and the description thereof is omitted.

The casing 86 is in an approximately box shape without a part of side faces and a top face. The top lid 87 in the shape of a thin plate is fitted over the casing 86 from above. A hollow portion is formed between the top lid 87 and the casing 86. It is preferable that solid grains or pellets as a weight are loaded into the top wall member 85. It is preferable that the solid grain or pellet is made out of resin with larger specific gravity than the rinsing solution 29. After loading, the top lid 87 is ultrasonically welded or adhered to the casing 86 in order to preventing the solid grains or the pellets from coming out of the casing 86. When the top wall member 85 is composed of plural parts welded or adhered to each other like this, the top wall member 85 is disposed in such a manner that the welding surface of the parts is positioned above the liquid level of the rinsing solution 29. Especially in the event of containing the filling liquid in the top wall member 85, the rinsing solution is prevented from getting into the top wall member 85 through the welding surface, so that it is possible to prevent change in specific gravity due to the mixture of the rinsing solution and the filling liquid.

It is preferable that the solid grain or the pellet as the filler is a PET (polyethylene terephthalate) resin pellet, a PBT (polybutylene terephthalate) resin pellet, or crushed goods molded from PET resin or PBT resin. Especially, a recycled resin pellet of a PET bottle being an eco-friendly material is extremely preferable in view of LCA (life cycle assessment, an environmental load evaluation method instituted by the International Standards Organization (ISO)).

It is preferable that the specific gravity of the solid grain or the pellet is more than or equal to 1.15, and more than or equal to 1.25 is better. The solid grain or the pellet the specific gravity of which satisfies this value is available as the filler. It is preferable, however, to use the filler made out of resin with high gravity without containing an additive such as glass fiber, filler or the like, in view of recycling the whole apparatus. From the viewpoint of specific gravity and recycling, PET resin (specific gravity=1.37) and PBT resin (specific gravity=1.31) are optimum for the filler.

The predetermined number of solid filler such as the pellets may be packed in a bag such as a plastic bag. The filler packed in the bag are loaded into the rack 39. In the above embodiment, the filler is loaded into the top wall member 55. The filler, however, may be loaded into other components of the rack 39, for example, the sidewall members 52 and 53 and the feed roller 41.

In the above embodiment, the photosensitive material processing rack is fitted into the rinse tank. The rack, however, may be fitted into another processing tank containing another type of processing solution. Instead of the photosensitive material processing rack which feeds the photosensitive material in solution, a crossover type of photosensitive material processing rack may be fitted.

In the above embodiment, the filler the specific gravity of which is larger than that of the processing solution is loaded into the hollow rack 39 or/and the feed rollers 41 to cancel the buoyant force exerted on the rack 39, but the present invention is not limited to it. When the photosensitive material processing rack and the filler are so formed as to satisfy the following formulas (1) to (3), the rack is prevented from floating by loading the filler in the hollow portion.

$$\beta > (V \times \alpha - W)/X \quad (1)$$

$$V \times \alpha > W \quad (2)$$

$$X \leqq v \quad (3)$$

Wherein, W is the weight of the rack 39 without filler, V is the volume of soaked portion of the rack 39 in the processing solution, v is the volume of hollow portion of the rack 39, α is the specific gravity of the processing solution, β is the specific gravity of the filler, and X is the volume of the filler loaded into the hollow portion. In the rack 39 and filler satisfying the formulas (1) to (3), when the filler is not loaded, the rack 39 floats in the processing solution by the buoyant force. In loading the filler, the rack 39 becomes heavy enough to prevent the rack 39 from floating.

In the above embodiment, the filler is loaded into the rack 39. Instead of or in addition to this, however, a loading portion on which a weight for weight regulation is put is provided in the upper portion of the rack 39. In this case, the rack 39 does not float in the processing solution by satisfying the above formulas (1) to (3), wherein W is the total weight of the weight and the filler.

Although the present invention has been described with respect to the preferred embodiment, the present invention is not to be limited to the above embodiment but, on the contrary, various modifications will be possible to those skilled in the art without departing from the scope of claims appended hereto.

What is claimed is:

1. A photosensitive material processing rack detachably fitted into a processing tank containing processing solution to feed a photosensitive material in said processing solution, said photosensitive material processing rack comprising:

a housing;

a feed roller pair provided in said housing, said feed roller pair feeding said photosensitive material along a feeding path in said processing tank; and a weight detachably loaded into and/or onto said housing, said weight stably fixing said rack in said processing tank against buoyant force exerted on said rack in said processing solution.

2. A photosensitive material processing rack as recited in claim 1, wherein at least one hollow portion is formed in said housing, and said weight is loaded into said hollow portion.

3. A photosensitive material processing rack as recited in claim 2, satisfying the following formulas:

$$\beta > (V \times \alpha - W)/X$$

$$V \times \alpha > W$$

wherein, W is the weight of said rack without said weight, V is the volume of a part of said rack soaked in said processing solution, α is the specific gravity of said processing solution, β is the specific gravity of said weight, and X is the volume of said weight.

4. A photosensitive material processing rack as recited in claim 3, satisfying the following formula:

$$X \leqq v$$

wherein, v is the volume of said hollow portion formed inside said housing.

5. A photosensitive material processing rack as recited in claim 3, wherein the gravity a of said processing solution and the gravity β of said weight satisfy the following formula:

$$\beta \geqq \alpha.$$

6. A photosensitive material processing rack as recited in claim 2, wherein said housing comprises:

an inlet for loading said weight into said hollow portion; and a lid detachably fitted over said inlet, wherein said inlet is positioned above the liquid level of said processing solution when said weight is loaded into said housing.

7. A photosensitive material processing rack as recited in claim 2, wherein said housing comprises plural members, said plural members are so welded to each other as to form said hollow portion between said plural members, and a welding surface of said members is positioned above the liquid level of said processing solution.

8. A photosensitive material processing rack as recited in claim 2, wherein said weight is liquid.

9. A photosensitive material processing rack as recited in claim 2, wherein said weight is solid grains or pellets.

10. A photosensitive material processing rack as recited in claim 9, wherein said weight is made out of PET (polyethylene terephthalate) or PBT (polybutylene terephthalate).

11. A photosensitive material processing apparatus comprising:

plural processing tanks containing processing solution;

a rack detachably fitted into each of said processing tanks, said rack having a feed roller for feeding a photosensitive material in said processing solution; and a weight detachably loaded into and/or onto said rack, said weight stably fixing said rack in said processing tank against buoyant force exerted on said rack in said processing solution.

12. A photosensitive material processing apparatus as recited in claim 11, wherein at least one hollow portion is formed in said rack, and said weight is loaded into said hollow portion.

13. A photosensitive material processing apparatus as recited in claim 12, satisfying the following formulas:

$$\beta > (V \times \alpha - W)/X$$

$$V \times \alpha > W$$

wherein, W is the weight of said rack without said weight, V is the volume of a part of said rack soaked in said processing solution, α is the specific gravity of said processing solution, β is the specific gravity of said weight, and X is the volume of said weight.

* * * * *